United States Patent [19]

Greenwich

[11] 4,022,115

[45] May 10, 1977

[54] METHOD AND APPARATUS FOR ERECTING PAPER TRANSPLANT POTS

[76] Inventor: Warren W. Greenwich, 601 Ferndale Congo Road, Little Rock, Ark. 72204

[22] Filed: May 10, 1976

[21] Appl. No.: 685,197

[52] U.S. Cl. ..... 93/49 R; 47/74; 47/77; 93/52; 93/36.05; 249/172

[51] Int. Cl.[2] ..... B31B 1/28

[58] Field of Search ..... 47/37; 93/1 D, 36.05, 93/36 R, 49 R, 49 M, 52; 249/172

[56] References Cited

UNITED STATES PATENTS

| | | | |
|---|---|---|---|
| 94,202 | 8/1869 | Gustafson | 47/37 |
| 681,066 | 8/1901 | Millingar | 47/37 X |
| 1,046,050 | 12/1912 | Bliss | 93/1 D X |
| 1,748,808 | 2/1930 | Toyoshima | 93/1 D |
| 2,576,153 | 11/1951 | Tannenberg | 249/172 X |
| 3,148,599 | 9/1964 | Moore | 93/36 R |

*Primary Examiner*—Roy Lake
*Assistant Examiner*—Paul A. Bell
*Attorney, Agent, or Firm*—Ralph R. Pittman

[57] ABSTRACT

A forming apparatus, particularly adapted for use by home gardeners, enables the erection of a square sheet of paper, which may be used newsprint paper, into a soil-decomposable pot suitable for raising and transplanting seedlings. Selected portions of the paper blank are adhesively treated and folded over a combined truncated pryamidal core and an associated drying stand, the latter being removable for upright positioning to dry and harden the mounted pot.

8 Claims, 8 Drawing Figures

METHOD AND APPARATUS FOR ERECTING PAPER TRANSPLANT POTS

BACKGROUND

Transplant pots, some saturated with fertilizing elements, insecticides or fungicides and of a material decomposable in soil, are widely used in horticulture for raising and transplanting seedlings. Having no salvage value, it is desirable that the pots be made available at the lowest possible cost; for this reason, cardboard or paper are popular structural materials.

Of these, the cardboard pot is the more expensive because of its greater weight and also because the blank from which the pot is erected usually requires scoring for defining bend lines and some sort of punching or gluing for holding the pot in the desired shape.

Used newsprint paper appears to be the most available and the lowest cost material; some pots have been made by first disintegrating the used newsprint to form a pulp and molding the pot from the paper-pulp material.

SUMMARY OF THE INVENTION

The apparatus described herein is particularly suitable for use by the home gardener, for the reason that it enables the erection of a transplant pot from a single sheet of paper stock, which may be used newsprint paper.

The apparatus consists of the combination of a square base plate having hinged side panels, a drying stand having four diverging legs and a central manipulating handle, and a core in the shape of an inverted frustum of a square pyramid having grooves along each of the upwardly sloping corners.

In operation, a paper blank is approximately centered on the base, the drying table inverted with its top resting near the central portion of the blank, and the core, guided by the central handle and the diverging legs of the drying stand, is disposed upon the inverted top of the drying stand.

Following such positioning of the three principal members, the four hinged panels of the base plate are swung upwardly to a latched position along the exterior of the core. This operation forms the unclamped portions of the blank into four pockets extending outwardly from the corners of the core. A water base adhesive is applied to the inside of the pockets and to one external side, and the pockets are serially folded around the core and flattened against the walls thereof, each folding operation being followed by the relatching of hinged base panels in their upstanding positions and over the folded portions of the blank.

All of the hinged panels are then unlatched and swung downwardly away from the core, the core along with the associated drying stand are lifted by the central handle, the core slidably removed from the drying stand and the latter, bearing the erected pot, is set apart on its legs in the upright position to permit the erected pot to dry and harden.

DESCRIPTION OF THE PREFERRED EMBODIMENT

The apparatus is a combination of the base member 10, the core 11 and the intermediate member 12, the latter functioning as both a form member and a drying stand.

Figure 4:
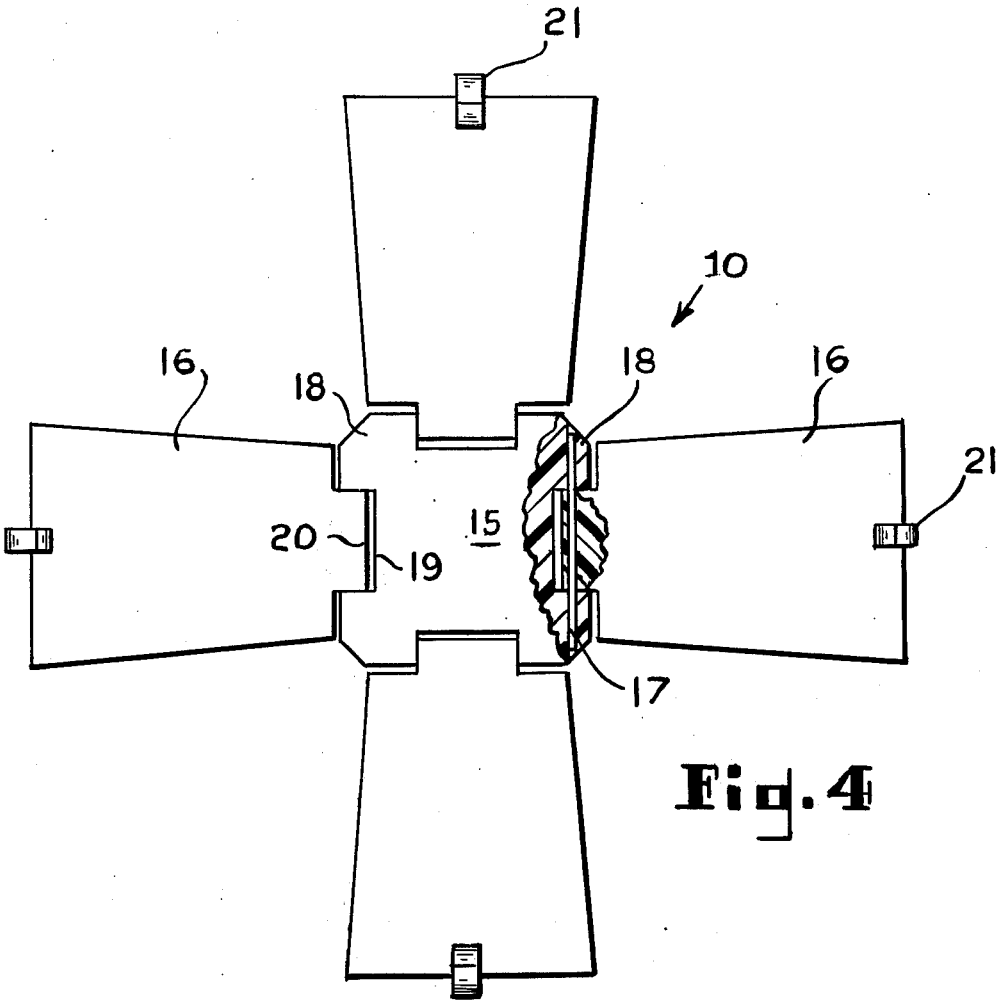
FIG. 4 illustrates the extended base member, a fragmentary section showing the hinge structure for attaching the side panels to the base plate.

The base member 10, shown in FIG. 4, has a central base plate 15, generally square shaped with symetrically chamfered corners. A rectangular recess 19 extends inwardly from each outer margin of the base plate 15, the coextensive inner margin of each recess 19 extending equidistantly from a center line bisecting the base plate 15 to form a pair of hinge-joint projections 18 along each outer edge of the base plate 15.

A generally trapezoidal side panel 16 is hingedly attached to each of the sides of the base plate 15, extending outwardly in coplanar relationship therewith, the opposing non-parallel margins of each of the side panels 16 extending in divergent relationship. A centrally located and complimentarily shaped hinge-joint projection 20 from the inner margin of each of the side panels 16 extends into each of the base plate recesses 19, and a hinge pin 17, passing through aligned bores in the projections 18 and 20, hingedly fastens each of the side panels to the base plate 15.

Figure 6:
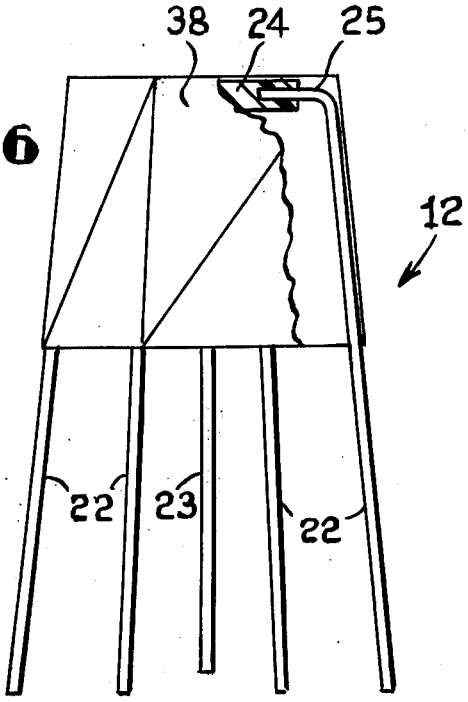
FIG. 6 is an elevational view of the drying stand, upon which a fragmentary portion of a drying erected pot is shown.

The drying stand 12 is shown in the upright posture at FIG. 6. The flat top plate 24 of the drying stand 12 is secured to each of the four legs 22 by the insertion of an inwardly bent upper end portion 25 of each leg into each corner margin of the top plate 24, the members being adhesively joined.

Figure 2:
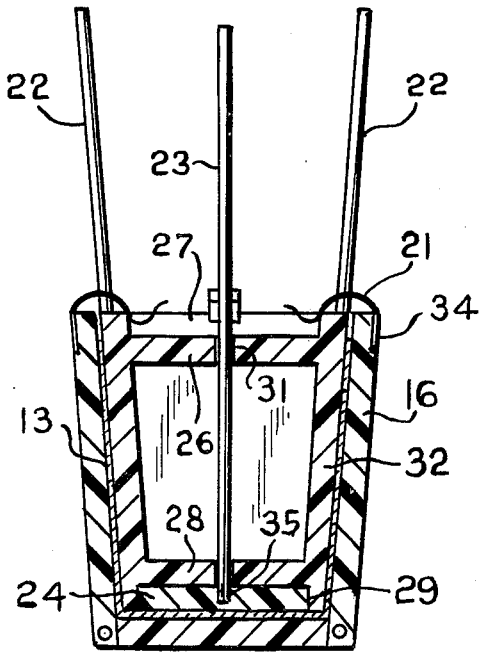
FIG. 2 is a sectional view of the apparatus, in which the hinged side walls are shown in the latched position for clamping the sides of an erected pot against the sides of the core.

As shown at FIG. 2, wherein the drying stand 12 is utilized in an inverted position as a member of the forming apparatus, a centrally positioned manipulating handle 23 is rigidly secured at the center of the top stand plate 24, as indicated by the numeral 35, the handle 23 extending normally from the lower surface between the legs 22 and coextensively therewith, the length of the handle 23 being no greater than the length of the legs 22.

Figure 1:
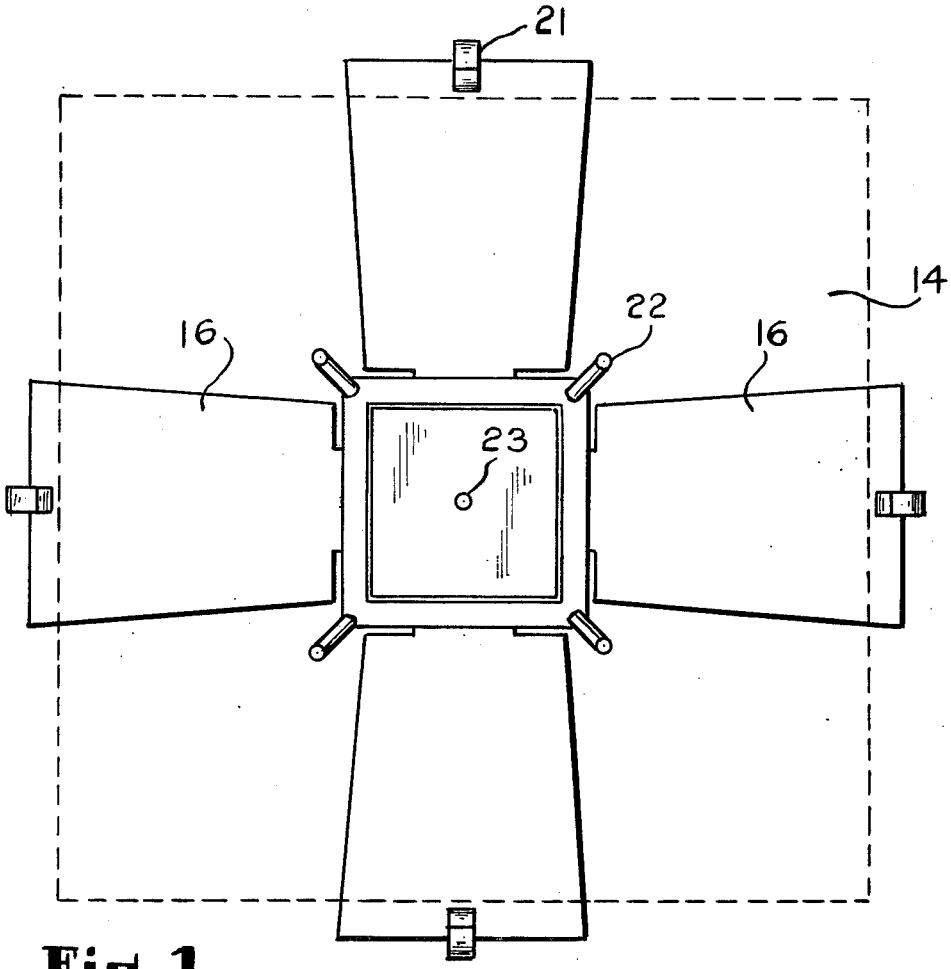
FIG. 1 is a plan view of the invention, the hinged side panels of the base member being shown in the open unlatched position; the dashed lines showing in outline the position of a paper blank resting on the base member under the core and associated drying stand.
Figure 3:
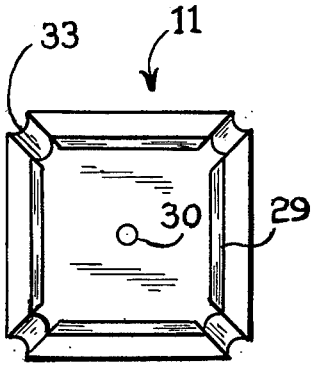
FIG. 3 is a plan view, from below, of the core, showing the corner grooves for receiving the legs of the drying stand for guidance thereby.

A plan view of the core 11, viewed from below, is shown at FIG. 3; a plan view, seen from above, appears at FIG. 1; and a sectional view appears at FIG. 2. The exterior surface of the core 11 is generally in the shape of an inverted frustum of a square pyramid, the side walls 32 extending divergently upward from the bottom 28 to an elevation above the upper surface of the top 26 to define the upwardly projecting peripheral flange 27. Similarly, a portion of the core side walls 32 extends downwardly below the lower surface of the bottom 28 to define the depending peripheral flange 29. The shape and size of the flange 29 corresponds to the square defined by the projection of each of the internal margins of the base plate recesses 19, and the trapezoidal side walls 32 of the core 11 correspond in size and shape to the hinged panels 16 of the base member 10.

A pair of vertically aligned apertures 31 and 30, located respectively at the midpoints of the top 26 and the bottom 28 of the core 11 provide a passageway for the centrally located manipulating handle 23 of the drying stand 12, and inwardly directed grooves 33 are provided along each of the four sloping corners of the core 11 for slidable reception of the four legs 22 of the drying stand 12.

In use, a single square sheet paper 14, which may be used newsprint, is first placed on the flat base member 10, the blank being slightly smaller than the overall extended width of the base member 10. Soil decomposition considerations indicate the desirability of a paper stock having the minumum thickness which will provide adequate structural strength; a paper easily folded to three layers is preferred.

The drying stand 12 is placed, in inverted posture, upon the blank approximately over the central portion of the blank. The core 11, guided by the coaction of the legs 22 with the corner grooves 33 and the handle 23 with the apertures 30 and 31 is rested upon the underside of the inverted stand top panel 24, the latter occupying the recess formed by the depending flange 29 and the latter merging with the top 24 to define a coplanar surface resting upon the blank.

The hinged panels 16 are then swung upwardly, carrying with them the engaged portion of the paper blank. The S-shaped spring latch member 21 has an extended portion adhesively secured near the outer margin of each of the swingable side panels 16, as indicated at the numeral 34 of FIG. 2, the catch portion of the latch member engaging the inner surface of the upper flange 27 of the core 11 for latching the swingable side panels 16 in the upstanding position.

The assembled core and drying stand are freely movable over the surface of the paper blank, and in response to the sliding contact of the lower ends of the hinged panels 16 with the lower peripheral flange 29 of the core, the assembly is moved as necessary to center itself over the central base plate 15.

Figure 7:
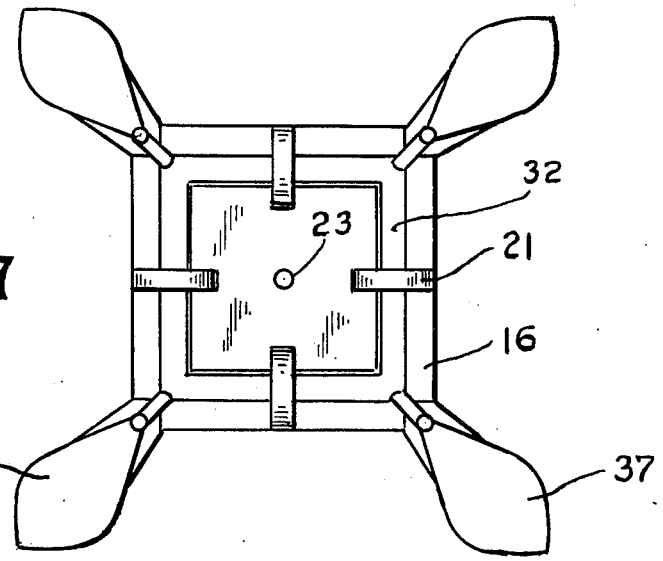
FIG. 7 is a plan view of the invention, illustrating the configuration of the paper blank at an intermediate step during its erection.
Figure 8:
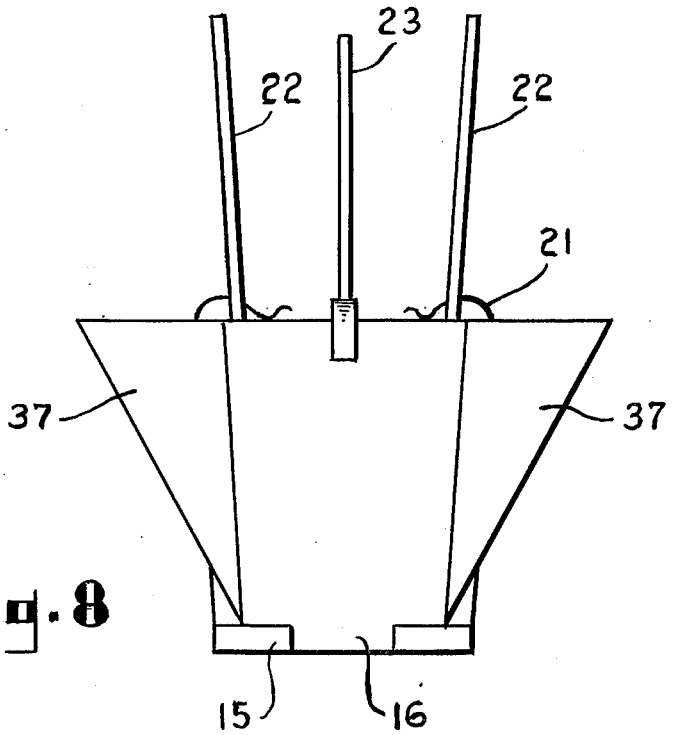
FIG. 8 is an elevational view corresponding to the plan view of FIG. 7.

As shown in FIGS. 7 and 8, those portions of the paper blank not clamped between the hinged side panels 16 and the core side walls 32 are squeezed outwardly from the upstanding corners of the assembly, thereby forming the set of four equally spaced, triangularly shaped open top pockets 37. The pockets 37 provide convenient receptacles into which some water-vehicle adhesive, to which may have been added fertilizer, insecticide or fungicide, is placed, and one side of the pocket is also coated with adhesive. One conveniently available, soil-decomposable adhesive is a water-wheat flour paste.

Following adhesive treatment of the projecting pockets, one of the side panels 16 is swung to the open position and the pocket is bent over the adjacent portion of the round drying stand leg and folded along the core wall, the coated side of the pocket being manually pressed into contact with the exposed portion of the blank and the sides of the pocket flattened into contact with each other. The open side wall panel 16 is then relatched in the upstanding position. Each adjacent pocket is similarly treated in sequence around the core, resulting in the erection of the blank assuming the shape shown at FIG. 5.

In removing the formed pot for drying, the hinged side panels 16 are all swung downward to their open position, the core is endwise slidably removed from the legs of the drying stand, and the drying stand, with the erected paper pot thereon, is set aside in the upright position illustrated at FIG. 6.

Figure 5:
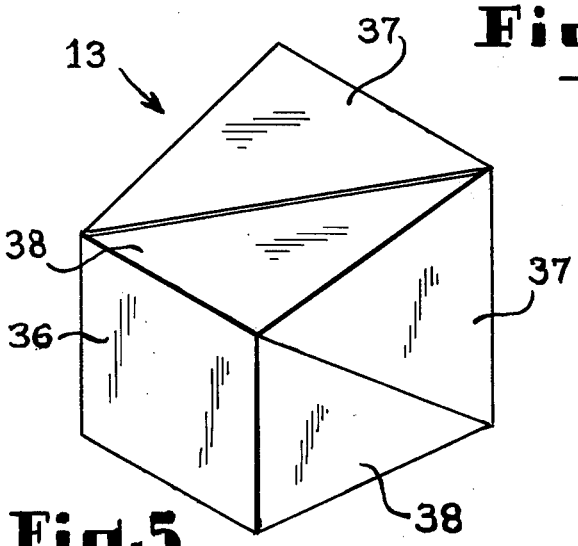
FIG. 5 is an isometric view of an erected transplant pot.

The drawing at FIG. 5 assumes that the transplant pot has been erected from a single layer paper blank. Under this condition, the bottom 36 is a single layer in thickness, and each of the tapered side walls consists of two triangular segments differing in thickness, the segment 37 being of triple layer thickness, and the segment 38 being of a non-folded single layer thickness.

What is claimed is:

1. In apparatus for erecting a paper sheet to form a transplant pot, said apparatus including a pyramidal core in the shape of the frustum of an inverted square pyramid and a base member including a generally square underlying base plate having outwardly directed hinged side panels swingably movable to interfacially engage the sloping sides of said pyramidal core, the improvement comprising:

the interposition of a detachable inverted four-legged drying stand between said core and said base.

2. The apparatus according to claim 1, wherein each sloping corner of the pyramidal core is grooved, and a leg of said drying stand engages each of the grooved corners along the full length thereof.

3. The apparatus defined in claim 1, wherein each of the legs of said drying stand project upwardly and outwardly beyond the upper surface of the inverted pyramidal core.

4. The apparatus as claimed in claim 1, including a latch member secured to the outer end portion of each of said swingably movable panels, said latch member engaging a portion of the top of said pyramidal core for latching the associated panel thereto.

5. The apparatus as set forth in claim 1, wherein an axially apertured passageway extends vertically through said pyramidal core and a manipulating handle is secured to the top of said inverted drying stand, said handle extending upwardly through said passageway to a point above the top of said core.

6. Apparatus for erecting a polygonal paper sheet to form a seedling transplant pot comprisng the combination of;

an inverted drying stand having a square top plate and a leg secured to each corner of said top plate, said legs extending first outwardly and thence divergently upward from the corners;

a pyramidal core in the shape of the frustum of an inverted square pyramid having a corner groove extending along each upwardly directed corner of the frustum;

said pyramidal core having a lower peripheral flange depending from the lower margin of the bottom of said core, said flange defining an upwardly extending recess into which said top plate of said drying stand is fitted, the lower surface of the inverted top plate being coplanar with the lower surface of said depending flange and the legs of said stand extending within the corner grooves of said core and upwardly therealong to an elevation above the top of said pyramidal core; and a blank-receiving base including a generally square base plate complimentarily underlying said stand and core and in registration with the lower planar surface thereof;

a swingably movable side panel hingedly connected to each side of the base plate and extending coplanarly therefrom, each side panel flaring outwardly from a side of said base plate in conformity with an associated side wall of said pyramidal core and being swingable upwardly to an upstanding position in which a portion of a paper blank is compressible in interfacial engagement between a side wall of said core and the associated swingable side panel;

an upper upwardly directed peripheral flange surmounting the top of said pyramidal core, and resilient latch means mounted at the outer end of each of said hinged side panels;

said latch means cooperating with said upper flange for latching each of said swingable side panels in their upstanding position.

7. The apparatus as claimed in claim 6, in which an axially. apertured passageway extends vertically through said core and said drying stand includes a manipulating handle passing through said passageway, the lower end of said handle being rigidly secured to the centerpoint of the inverted top of said inverted drying stand.

8. The apparatus in accordance with claim 6, wherein said core is a hollow truncated pyramid.

* * * * *